US005862853A

United States Patent [19]

Eliat

[11] Patent Number: 5,862,853

[45] Date of Patent: Jan. 26, 1999

[54] MOVABLE INSERT FOR DIE-CASTING MOLD WITH RETRACTABLE CORE

[75] Inventor: Constantin Eliat, Burlington, Canada

[73] Assignee: Amcan Castings Limited, Hamilton, Canada

[21] Appl. No.: 728,913

[22] Filed: Oct. 11, 1996

[51] Int. Cl.[6] ..... B22D 17/24

[52] U.S. Cl. ..... 164/340; 164/137; 249/63; 249/167; 249/177; 425/468; 425/DIG. 10

[58] Field of Search ..... 425/468, DIG. 10; 164/340, 341, 137; 249/63, 64, 167, 177

[56] References Cited

U.S. PATENT DOCUMENTS

| | | | |
|---|---|---|---|
| 617,396 | 1/1899 | Hay | 249/64 |
| 3,433,292 | 3/1969 | McDonald | 249/64 |
| 3,442,323 | 5/1969 | Lewis et al. | 164/340 |
| 3,849,053 | 11/1974 | Bruce et al. | 425/468 |
| 4,919,189 | 4/1990 | Sato et al. | 249/64 |

FOREIGN PATENT DOCUMENTS

| | | | |
|---|---|---|---|
| 58-192652 | 11/1983 | Japan | 164/340 |

*Primary Examiner*—Robert Davis
*Attorney, Agent, or Firm*—Rogers & Milne

[57] ABSTRACT

A movable insert for a die-casting mold having a cavity in which a core is mounted and slidable between a retracted position in the cavity and an extended position in which the core extends from the movable insert core. The core has a connector releasably connecting the core to a locator. The locator moves the core between the retracted and extended positions.

9 Claims, 5 Drawing Sheets

MOVABLE INSERT FOR DIE-CASTING MOLD WITH RETRACTABLE CORE

FIELD OF THE INVENTION

This invention relates to die-casting molds and more particularly to die-casting molds for manufacturing parts having a recess extending away from a movable insert.

BACKGROUND OF THE INVENTION

Metal die-casting processes generally utilize a mold having a fixed insert presenting a first mold face which is pressed up against a movable insert presenting a second mold face. Molten metal, such as aluminum, is injected into a space between the fixed insert and the movable insert. The molten metal is allowed to solidify in the space and then the fixed and movable inserts are separated in a direction referred to herein as the "machine direction". The solidified metal (now a die-cast part) generally remains with the fixed insert and is removed or "stripped" from the fixed insert.

As long as the part only includes portions that taper away from the movable insert in the machine direction, forming and stripping are relatively straightforward. Occasionally, however, a part will include an opening which extends away from the movable insert in a direction not parallel to the machine direction and which must be surrounded by metal. If the part does not have a reduced diameter or breadth portion along the length of the opening, this can be accommodated by a "slide" that is pressed up against the core during forming and withdrawn prior to stripping of the part from the core.

Occasionally however, it is desirable to form such an opening which has a reduced breadth or diameter portion along its length with a larger diameter or breadth portion adjacent the movable insert. FIG. 1 is a sectional view of a prior art mold assembly for forming such a part.

FIG. 1 illustrates a typical movable insert at reference 10 and fixed insert 12 for molding a part 14 having an opening 16 which is narrower at reference 18 than it is adjacent the movable insert 10. To form the enlarged diameter portion adjacent the movable insert 10, an added (or "loose") core 20 is mounted over a shaft 22 extending from a slide 24. The mold, generally indicated by reference 26, is closed. Molten metal is injected into the space between the fixed insert 12, movable insert 10 and added core 24 to form the part 14. Once the molten metal has cooled, the slide is withdrawn and the movable insert 10 and fixed insert 12 are separated. The part, which will still contain the added core 20 is then stripped from the fixed insert and the added core 20 is pressed out.

Such a procedure is labour intensive and potentially dangerous, as an operator has to put their hand between the movable insert 10 and fixed insert 12 to place the added core 20 on the shaft 22. If the mold 26 were to inadvertently close, the operator's hand could get trapped and serious injury could result. Furthermore, if the added core 20 is not precisely mounted, defective parts may result.

It is an object of the present invention to provide a movable insert having a core which is movable between a retracted position in the movable insert to an extended position extending from the movable insert.

It is a further object of the present invention to provide such a core which is movable between the retracted and extended positions without manual intervention by a human operator.

It is a still further object of the present invention to provide means for preventing movement of the core toward the movable insert during molten metal injection.

It is another object of the present invention to provide a movable insert having a retractable core with means to lock the core in the retracted position.

It is yet another object of the present invention to provide a core locator releasably connectable to a retractable core for moving the core between its retracted and extended positions.

SUMMARY OF THE INVENTION

A movable insert for a die-casting mold having:

a cavity;

a core slidably mounted in said cavity and movable between a retracted position in which said core does not extend beyond said movable insert to an extended position in which said core extends from said movable insert; and, said core having a connector for releasably connecting said core to a locator which moves said core between said retracted and extended positions.

DESCRIPTION OF DRAWINGS

Preferred embodiments of the present invention are described below with reference to the accompanying drawings in which.

DESCRIPTION OF PREFERRED EMBODIMENT

Figure 1:
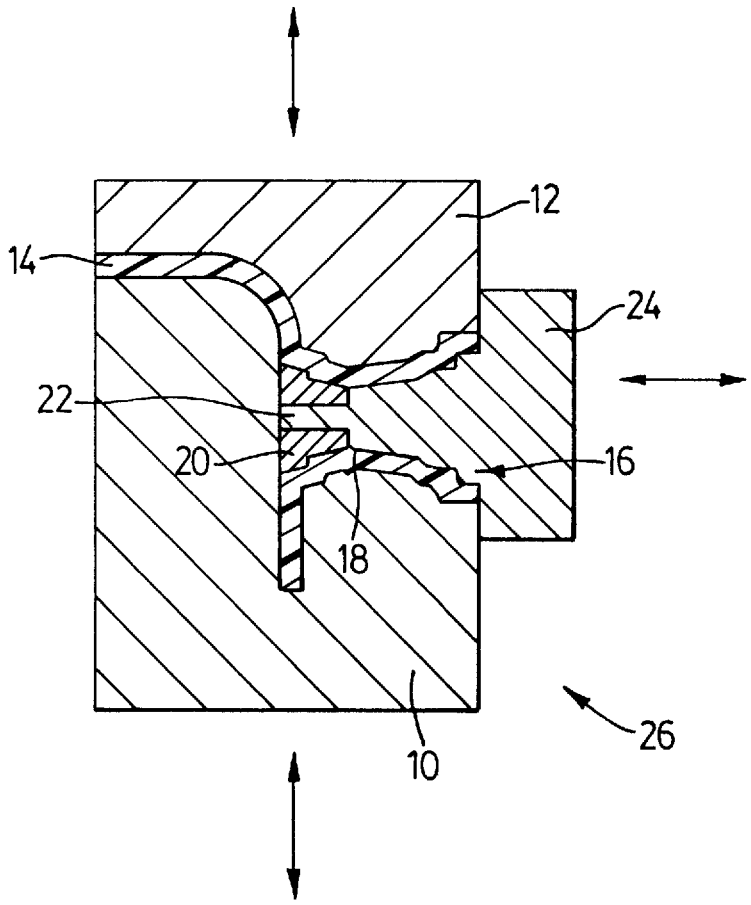
FIG. 1 (PRIOR ART)
FIG. 1 is a sectional view through a prior art mold assembly.

A mold assembly according to the present invention is generally indicated by reference 30. The mold assembly includes a movable insert 32, a fixed insert 34 and a slide 36. The mold assembly is generally opened and closed by moving the movable insert 32 away from the fixed insert 34 in a direction illustrated by arrows 38 and referred to herein as the "machine direction" as it is the principal direction of travel of a movable platen on a die-casting machine to which the mold assembly 30 would be secured.

The slide 36 would be provided with its own actuating means (not shown in FIG. 2) for moving the slide 36 in the direction of arrows 40 away from the balance of the mold assembly 30 to enable a finished part 42 to be removed.

As in the case of the prior art mold assembly 26 in FIG. 1, which is described in the background above, the part 42 includes a generally cylindrical opening or boss 44 which is narrower at a point 46 along its length than it is toward either end. As in the prior art assembly, a core 48 is used to form the opening 44. Unlike the prior art assembly, the core is not added or mounted on the slide 36, but instead, is mounted in a cavity 50 in the movable insert 32. The core 48 is movable by a locator 52 between an extended position shown in solid lines and a retracted position shown in dashed lines.

In use, the core 48 is moved by the locator 52 into the extended position prior to molten metal being injected into the mold assembly 30. Once the mold assembly 30 has been filled and the molten metal allowed to solidify, the core 48 is moved into its retracted position and the locator 52 is disconnected from the core 48 and withdrawn along with the slide 36, enabling the movable insert 32 and fixed insert 34 to be separated and the part 42 to be stripped. As the core 48 has been retracted into the movable insert 32, the core 48 will not remain with the part 42 and will not have to be pressed out of the part 42. Furthermore, the use of a mechanically actuated core 48 and locator 52 eliminates the previously required manual step of placing an added core onto the slide 36.

Figure 2:
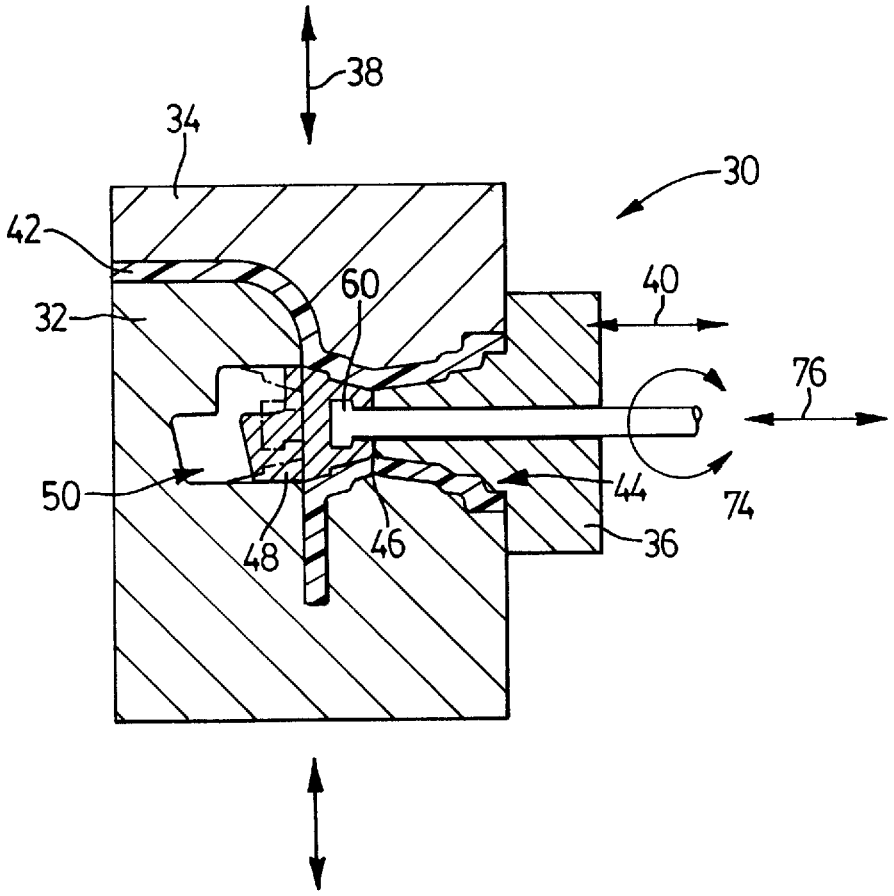
FIG. 2 is a sectional view through a mold assembly according to the present invention.

Although FIG. 2 illustrates a part 42 which requires the use of a slide 36, such may not always be required. For example, if the opening 44 ends at the right-hand end of the reduced diameter portion at 46, rather than broadening again as illustrated, the entire opening can be formed only using the core 48.

The operation and structure of the core 48 and the locator 52 will now be described in more detail with reference to FIGS. 3, 4 and 5.

Figure 5:
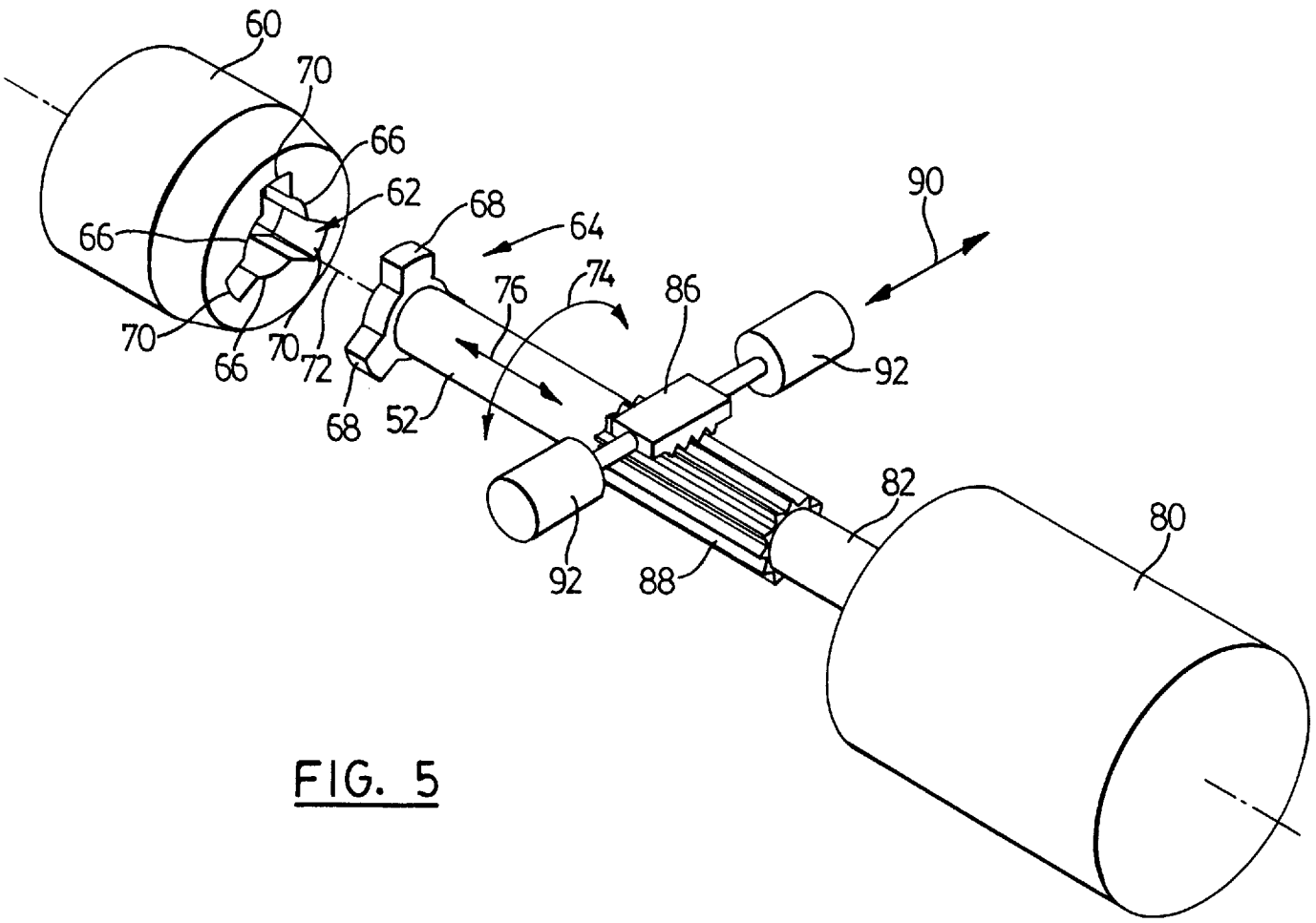
FIG. 5 is a perspective view of a connector and a locator according to the present invention.

FIG. 5 illustrates a connector 60 which would typically be formed into an outermost face 61 of the core 48. The connector 60 includes an aperture 62 which registers with an end 64 of the locator 52 to enable the end 64 of the locator 52 to be inserted through the aperture 62 into the connector 60 when the aperture is appropriately aligned in a first position as illustrated in FIG. 5.

The aperture is provided with a stop comprising three radially inwardly extending tabs 66. The end 64 has three corresponding outwardly extending tabs 68 (of which only 2 are visible in FIG. 5) which may pass through corresponding gaps 70 between the tabs 66 when the locator 52 is in its first position. Once the end 64 of the locator 52 has been inserted through the aperture 62 into the connector 60, the locator 52 is rotated approximately one third of a turn about its axis 72, in the direction of arrows 74 into a second position. In the second position the tabs 66 on the connector 60 and the tabs 68 on the locator 52 will interfere preventing removal of the end 64 of the spigot locator from the connector 60. Accordingly, movement of the locator 52 away from the connector 60 in a direction illustrated by arrows 76 will cause the connector 60 and in turn the core 48 to move with the locator 52 toward the extended position as illustrated in FIG. 3.

Retraction of the core 48 may be effected by a reversal of the above steps, namely, the locator 52 is moved toward the connector 60 and rotated to its first position enabling removal of the end 64 of the locator 52 from the connector 60.

Movement of the locator 52 in the direction of arrows 76 may be effected by a hydraulic cylinder 80 having a rod 82 connected to the locator 52. Rotation of the locator 52 about its axis 72 in the direction of arrows 74 may be effected by a rack 86 meshing with a pinion 88 cut into the rod 82 and driven in the direction of arrows 90 by two hydraulic cylinders 92, each of which is connected to an opposite end of the rack 86.

In practice, it has been found that means should be provided to lock the core 48 in the retracted and extended positions. Failure to lock the core 48 in the extended position may result in the pressure of the molten metal being injected tending to move core 48 into the cavity 50. Failure to lock the core 48 in its retracted position may result in the core 48 being at least partially sucked into its extended position by removal of the slide 36.

Figure 3:
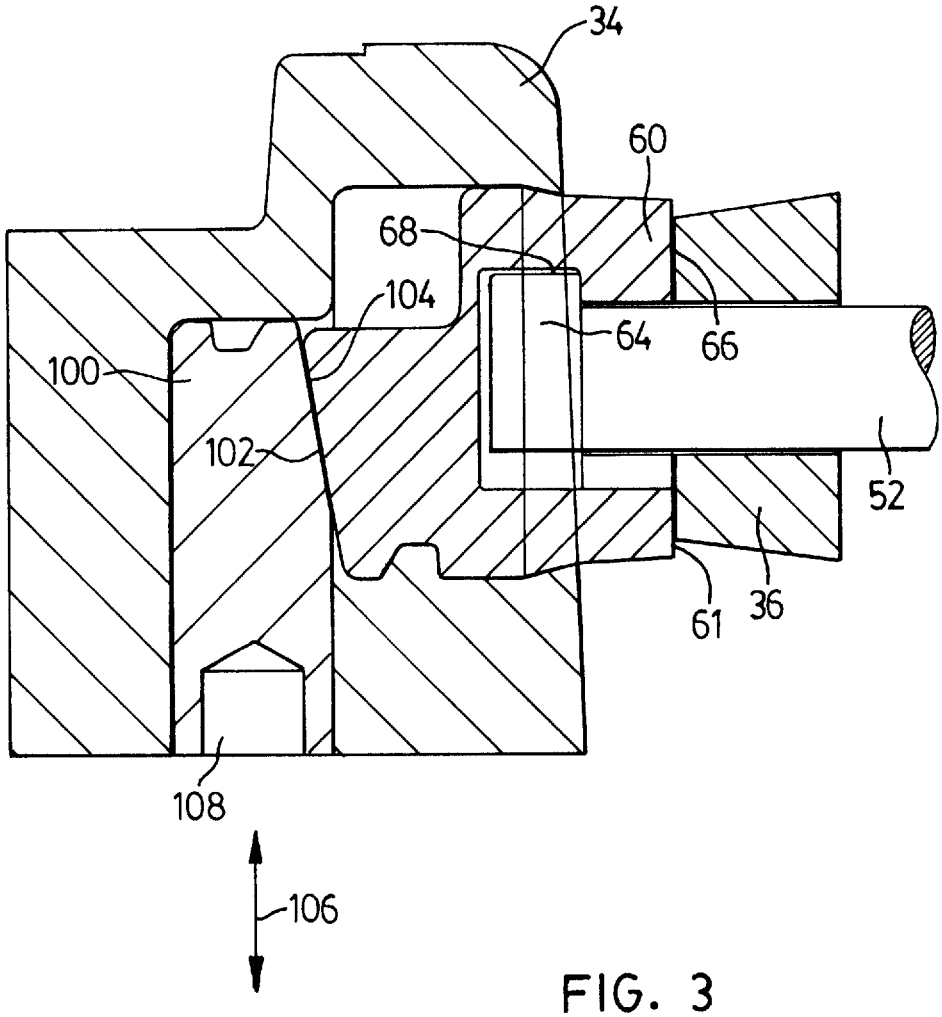
FIG. 3 is a sectional view through a movable insert according to the present invention showing a core in its extended position.

As illustrated in FIG. 3, to prevent movement of the core 48 into the cavity 50, a wedge shaped abutment 100 may be slidably inserted between a rear face 102 of the core 48 and a rear wall 104 of the cavity 50. Slidable movement of the abutment 100 in a direction shown by arrows 106 may be effected by a hydraulic cylinder (not shown) having a rod 108 connected to the abutment 100.

Figure 4:
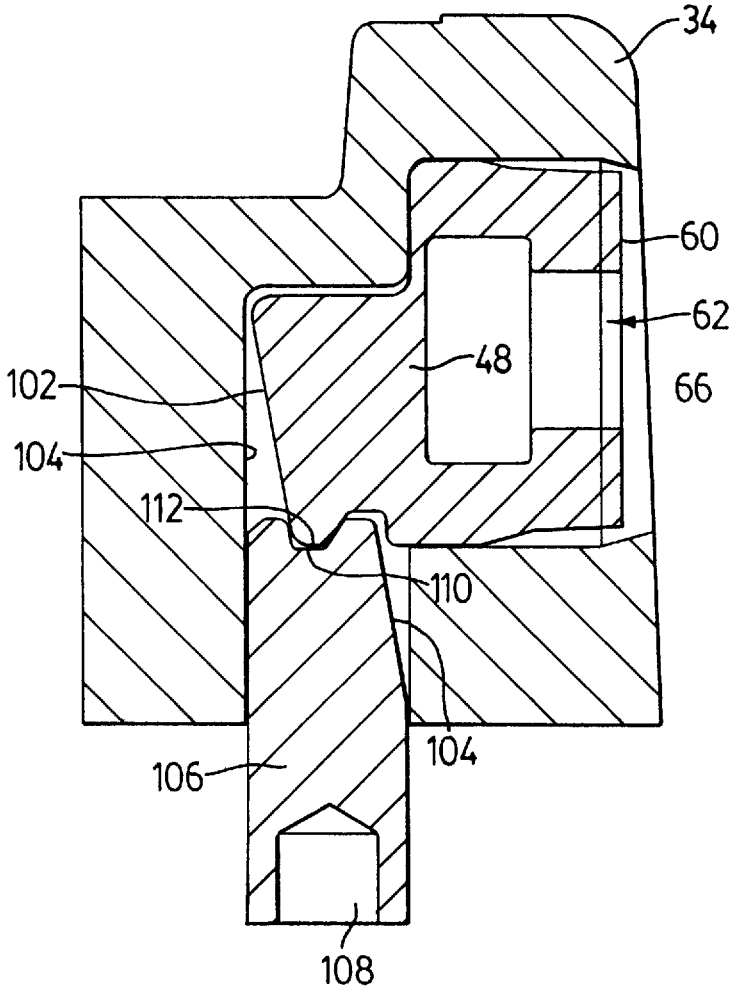
FIG. 4 is a section view through a movable insert according to the present invention showing a core in its retracted position.

As illustrated in FIG. 4, to prevent movement of the core 48 out of its retracted position, a core lock may be provided which includes a first component in the form recess 110 in an end of the abutment 100 which registers with and may be pressed into engagement with a corresponding second component or ridge 112 formed in the core 48 adjacent its rear face 102. Movement of ridge 112 into engagement with recess 110 may be effected by action of the rod 108.

The above description is intended in an illustrative rather than a restrictive sense. Variations may be apparent to persons skilled in the appropriate art while remaining within the spirit and scope of the present invention as defined by the claims set out below.

We claim:

1. A movable insert for die-casting mold having:

a cavity;

a core slidably mounted in said cavity and movable between a retracted position in which said core does not extend beyond said movable insert to an extended position in which said core extends from the movable insert; and, said core having a connector for releasably connecting said core to a locator for movement of said core between said retracted and extended positions.

2. A movable insert as claimed in claim 1 wherein said core is movable in a direction non-parallel to a machine direction to form a recess in a molded article extending away from said movable insert in said non-parallel direction.

3. A movable insert as claimed in claim 1 or 2 wherein said connector includes:

an aperture in said core for registering with an end of said locator when said locator is in a first position to allow insertion of said end of said locator through said aperture; and, a stop for engaging said end of said locator when said locator is rotated about its axis into a second position to prevent withdrawal of said end of said locator from said core when said locator is rotated into said second position.

4. A movable insert as claimed in claim 3 further including an abutment insertable between a rear face of said core and a rear wall of said cavity when said core is in said extended position to prevent movement of said core into said cavity.

5. A movable insert as claimed in claim 4 further including a core lock for locking said core in said retracted position.

6. A movable insert as claimed in claim 3 wherein:

said stop includes at least one radially extending tab for engaging at least one corresponding tab extending radially from said end of said locator.

7. A movable insert as claimed in claim 5 wherein:

said lock includes a first component on said abutment which registers with a second component on said core.

8. A movable insert as claimed in claim 7 wherein said first and second components are complementary members selected from the group consisting of a projection and a recess.

9. A movable insert as claimed in claim 5 wherein:

said core lock includes a recess at an inner end of said abutment which receives a ridge adjacent said rear face of said core; and, said stop includes at least one radially extending tab for engaging at least one corresponding tab extending radially from said end of said locator.

* * * * *